US006478181B1

(12) United States Patent
Krupa et al.

(10) Patent No.: US 6,478,181 B1
(45) Date of Patent: Nov. 12, 2002

(54) SHRINKABLE TRAY WITH ATTACHABLE LIDS

(75) Inventors: Calvin S. Krupa, Medina, MN (US); Robert Knoss, Anoka, MN (US); Richard T. Steichen, Elk River, MN (US)

(73) Assignee: Ivex Packaging Corporation, Lincolnshire, IL (US)

( * ) Notice: Subject to any disclaimer, the term of this patent is extended or adjusted under 35 U.S.C. 154(b) by 106 days.

(21) Appl. No.: 09/729,496

(22) Filed: Dec. 4, 2000

(51) Int. Cl.[7] ..... B65D 41/18

(52) U.S. Cl. ..... 220/573.1; 220/780; 220/4.24

(58) Field of Search ..... 220/287, 573.1, 220/574, 720–721, 780, 793, 4.24; 99/646

(56) References Cited

U.S. PATENT DOCUMENTS

| | | | | | |
|---|---|---|---|---|---|
| 1,134,427 | A | * | 4/1915 | Ullrich | 220/780 |
| 2,984,381 | A | * | 5/1961 | Bennett | 220/780 |
| 5,555,994 | A | * | 9/1996 | Chen | 220/287 |
| 5,695,086 | A | * | 12/1997 | Viola | 220/287 |
| 6,015,061 | A | * | 1/2000 | Lowry | 220/287 |

* cited by examiner

*Primary Examiner*—Nathan J. Newhouse
(74) *Attorney, Agent, or Firm*—Nikolai & Mersereau, P.A.

(57) ABSTRACT

Plastic trays used for baking shrink when in an oven such that lids which attached to the tray prior to baking no longer fit the tray after baking. Since the shrinkage of the tray is known for the temperature range expected during baking, a lid having two sets of locking tabs at different perimeters can be used to secure the lid to the tray. The first perimeter and locking tabs are used before the tray is baked and the second perimeter and locking tabs used after the tray baked. In this manner a tray with food therein can have a lid secured thereto before baking when the tray is one size and the same lid secured thereto after baking. The lid is removed during baking and reapplied after baking thus protecting the food in the tray before and after baking. Alternatively the tray may have two lid engaging perimeters for attaching the trays to the lids. The first tray perimeter used before baking and the second after baking. The lid would have one perimeter for engaging the tray before and after baking. The location for attaching the trays to the lids can be located anyplace around the trays and lids. The means for attaching the trays to the lids may be by inserting a concave portion into a concave portion, by inserting a portion of the tray or lid under tabs of the lid or tray or any other means of inserting lockingly securing the trays and lids together. The trays and/or lids may change size for a variety of reasons, including thermal expansion and contraction, thermoplastic shrinkage, or load stresses. The dual size containers will fit the lid to the tray before and after the size changes.

60 Claims, 5 Drawing Sheets

SHRINKABLE TRAY WITH ATTACHABLE LIDS

BACKGROUND OF THE INVENTION

1. Field of the Invention

The invention relates to containers with dual locking configurations, which can be used to securely latch a lid to a tray before and after one or both experience a size change. One application relates to plastic containers, which experience thermal shrinkage during the baking of food.

2. Description of the Related Art

Containers having a tray portion and a lid portion come secured to each other to protect the contents of the container from outside elements and or to prevent spillage of the contents. If the tray, the lid, or both expand or contract due to thermally induced dimensional changes, temperature changes, load stresses, or other interactions, the lid will no longer fit on the tray. It is desired that the container lid still fit on the tray both before and after one or both change size.

Plastic baking trays shrink in the oven during baking, as a result, prior art lids have been designed to fit the tray either before or after baking but not both before and after baking.

It is desirable to have tray lids that will attach to the tray both before and after the tray changes sizes due to thermally induced shrinkage. The tray lid should be securely locked onto the tray such that a good seal is maintained to protect the food therein.

In other applications a tray may have a first size before it is filled and a second size after it is filled. It is desirable to have tray lids that will attach to the tray both before and after the tray changes sizes due to stresses applied to or removed from the tray.

SUMMARY OF THE INVENTION

A container having a tray with a lid attached thereto is provided wherein the tray, the lid or both have two sets of engagement mechanisms in different locations, such that when the tray or lid is a first size a first set of engagement mechanisms are employed and when the tray and or lid is a second size a second set of engagement mechanisms are employed to secure the lid to the tray.

For example plastic trays are well suited for baking a variety of food products. However, one problem with such trays is that they shrink when subjected to heat at typical baking temperatures. In the past, separate covers would have to be provided to keep the food fresh. One cover would be used before baking and one after baking. The use of two covers substantially increases the cost of packaging and can lead to a level of inconvenience and dissatisfaction on the part of consumers.

The present invention solves these problems by providing a tray and a single lid to cover the food both before and after baking to keep the food fresh. A feature of the invention is to provide a tray and a lid arrangement with dual sets of closure elements, one set used before thermal shrinkage has occurred and the other used after the tray has experienced thermal shrinkage.

In one embodiment, the two sets of closure elements are provided on the lid so that one set fits and seals with the tray before baking and the other set fits and seals with the tray after thermal shrinking has occurred.

In another embodiment, the two sets of closure elements are provided on the tray and cooperate with members on the lid.

The invention can be used in conjunction with any of a variety of tray and lid designs and with trays and lids made of a variety of different plastic materials. Those skilled in the art can use well known techniques to measure or calculate shrinkage and then use the invention to produce products that require only a single cover.

OBJECTS OF THE INVENTION

It is an object of the invention to provide one lid that fits a tray of a first size before baking and also fits the same tray after it thermally shrinks to a second size due to baking.

It is an object of the invention to seal plastic baking trays with a single lid before and after baking food in the tray.

It is an object of the invention to provide a lid which is easy to open and close at two tray sizes.

It is an object of the invention to provide a lid with two sizes of engagement perimeters one for the size of the tray before baking and one for the size of the tray after baking.

It is an object of the invention to provide a tray with two sizes of engagement perimeters one for engaging the lid before baking and one for engaging the lid after baking.

It is an object of the invention to provide lids, which fit trays, subjected to thermal shrinkage.

It is an object of the invention to provide lids, which fit trays, subjected to thermal expansion.

It is an object of the invention to provide trays, which fit lids, subjected to thermal shrinkage.

It is an object of the invention to provide trays, which fit lids, subjected to thermal expansion.

It is an object of the invention to provide trays, which fit lids, subjected to stress shrinkage.

It is an object of the invention to provide trays, which fit lids, subjected to stress expansion.

It is an object of the invention to provide lids, which fit trays, subjected to stress shrinkage.

It is an object of the invention to provide lids, which fit trays, subjected to stress expansion.

Other objects, advantages and novel features of the present invention will become apparent from the following detailed description of the invention when considered in conjunction with the accompanying drawing.

DESCRIPTION OF THE PREFERRED EMBODIMENTS

Some containers have components such as lids and trays which engage each other to hold contents within the containers and keep foreign objects out. In some uses the container components will change size during the life of use and the lid will no longer engage the tray. In cases where only one component, such as the tray, is subjected to baking, the tray will experience thermoplastic shrinkage. Thereafter the tray and lid engagement will not be aligned and the lid can not be secured to the tray.

Although in the example above the tray changed size due to thermoplastic shrinkage, either the tray or the lid may be subjected to a change in size due to many forces such as thermal expansion and contraction, pressure changes, or load stresses.

In order to have a container in which the lid and tray will engage both before and after one or more or its components changes size, a container having two engagement portions on either the lid or tray or both are provided.

Figure 1:
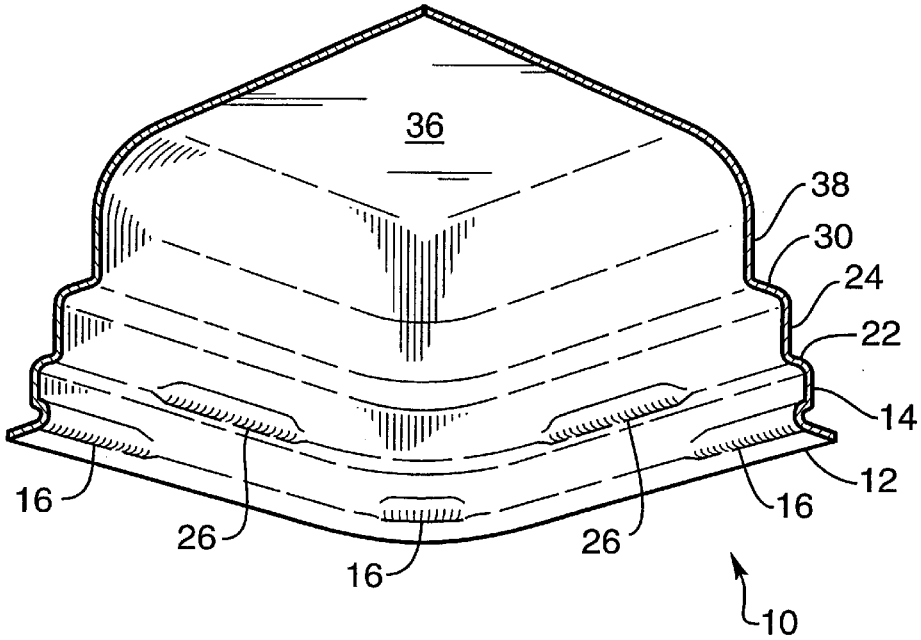
FIG. 1 is a top perspective view of a lid with two locking perimeters.

FIG. 1 is a perspective view of the outside of tray lid 10. The lid 10 has a flat rim 12 in a plane on which the lid 10 can rest when laid down. An outer perimeter riser 14 begins at and is generally perpendicular to the plane of the rim 12, the riser 14 defining an outer perimeter of the lid 10. Locking tabs 16 extend inward toward the center of the lid 10 from the riser 14.

Figure 3:
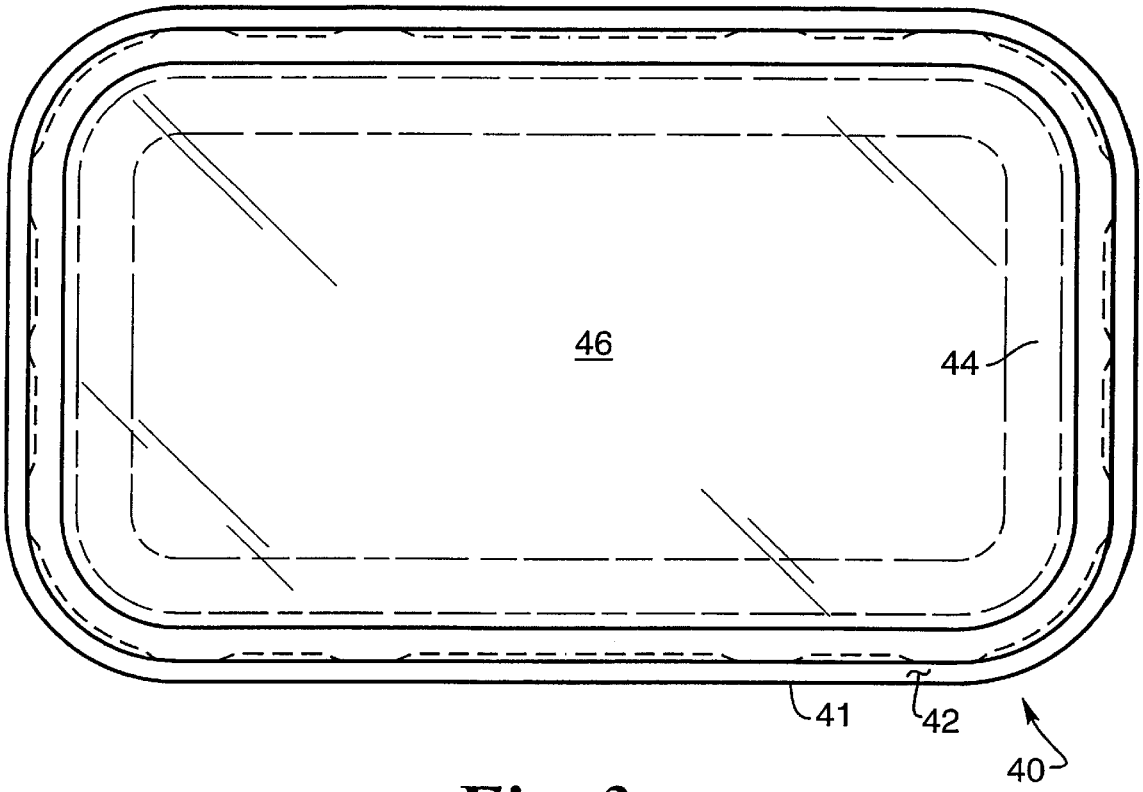
FIG. 3 is a top view of a tray for engaging the lids of FIGS. 1 and 2.

FIG. 3 shows a top view of a tray 40 having a bottom surface 46 a base wall 44 and a rim 42 having a rim edge 41 defining a perimeter of the tray 40.

The locking tab 16 on the lid 10 slides over the rim edge 41 of rim 42 on tray 40 and engages the top of the outer locking tab 16 to lock the tray lid 10 onto tray 40. The tray lid 10 is prevented from further movement on tray 40 by rim 42 engaging the runner 22 and the coplanar top of the locking tabs 26 which extend perpendicularly inward from riser 24 and define the upper limit of the length of riser 14. The lid 10 is therefore secured from movement either upward or downward to the range between the bottom of inner locking tabs 26 and the top of outer locking tab 16.

A riser 24 extends parallel to riser 14 on an inner perimeter as defined by the inner side of runner 22. The riser 24 extends from runner 22 to runner 30, which is parallel to rim 12. The runner 30 limits the movement of the tray rim 42 to a range between the top of inner locking tabs 26 and runner 30.

Figure 2:
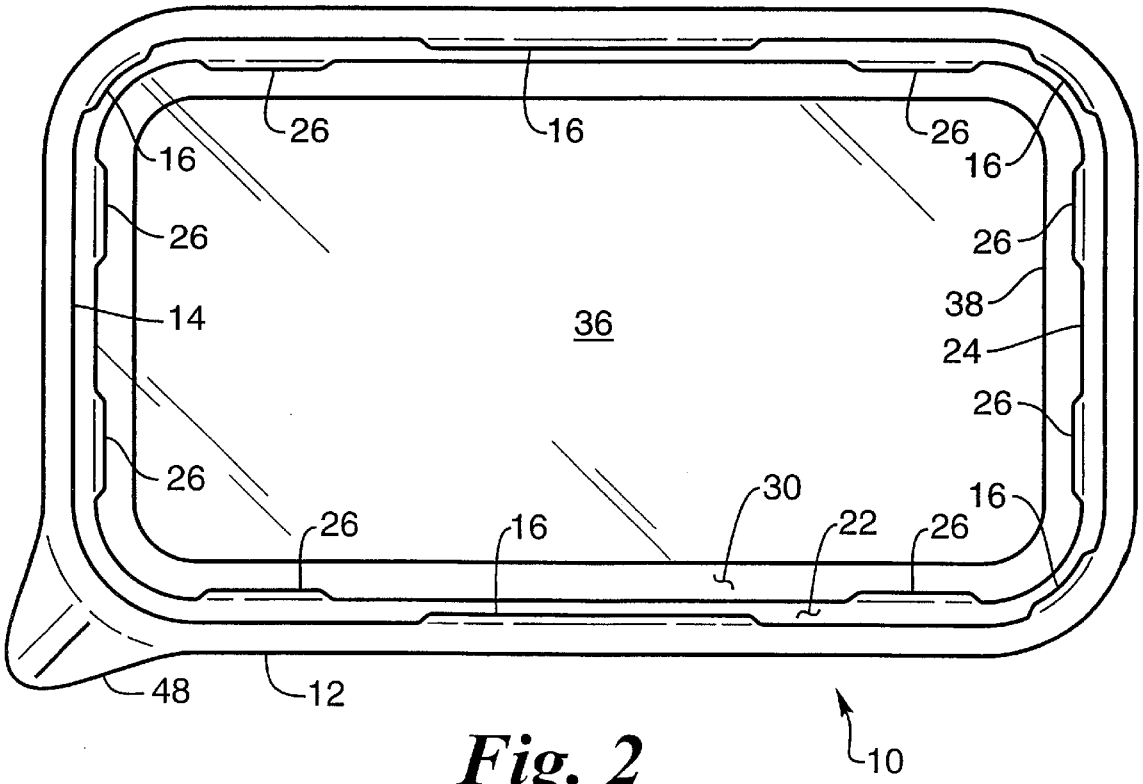
FIG. 2 is a bottom view of a lid two locking perimeters.

In FIG. 1 a perspective view of the tray lid 10 is shown, opposing sides are symmetric as shown by FIG. 2, a bottom view of the tray lid 10.

The lid 10 is easily removable from the tray 40 buy exerting a force on the removal tab 48 which provides leverage to deform the lid 10 such that either the outer 16 or inner 26 locking tabs are removed from under the tray rim 42.

Riser 38 extends between the lid surface 36 and the runner 30. Riser 38 gives the lid 10 added height such that the lid surface 36 does not come into contact with the contents of the tray 40 particularly when the tray is filled to a level over the top of the tray rim 42.

Figure 8:
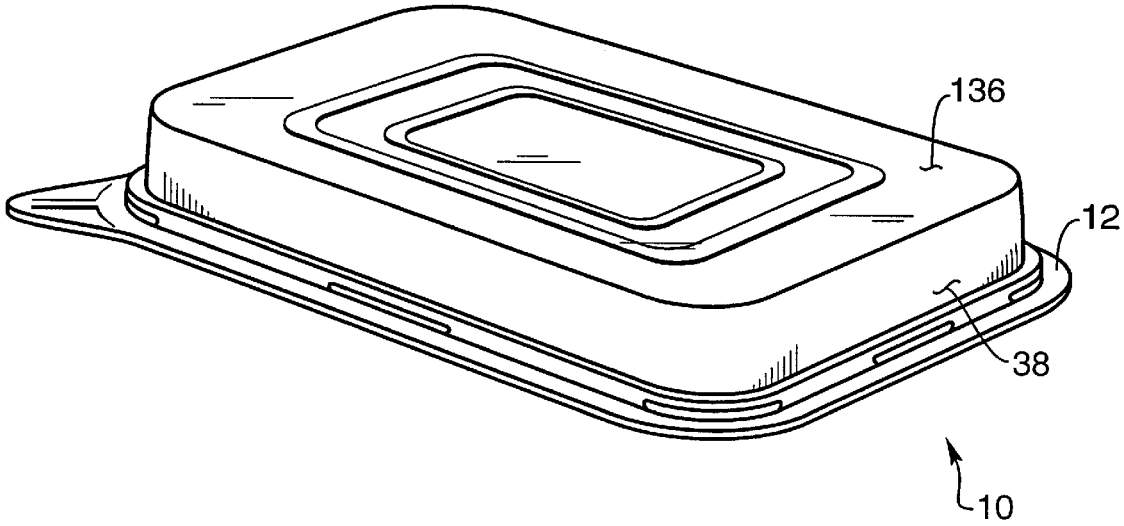
FIG. 8 is a top perspective view of a dome lid.
Figure 9:
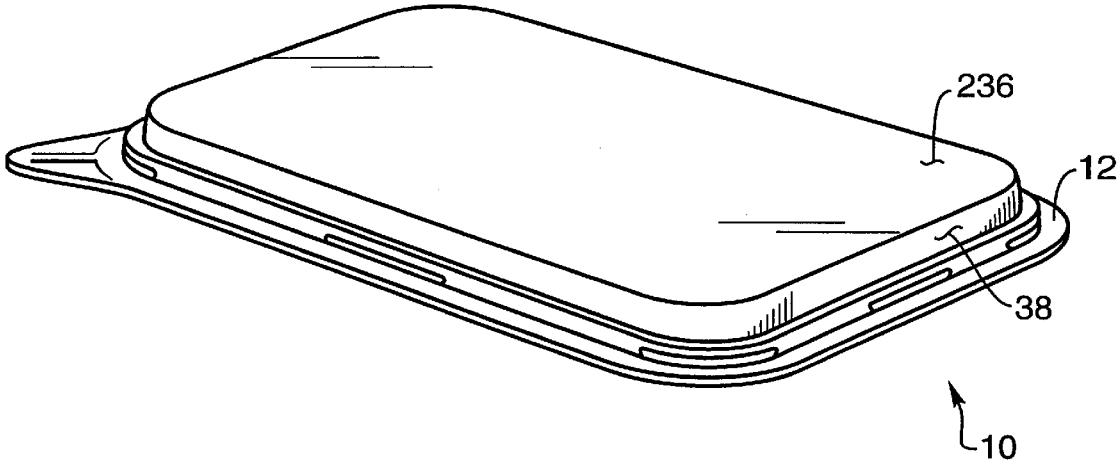
FIG. 9 is a top perspective view of a flat lid
Figure 10:
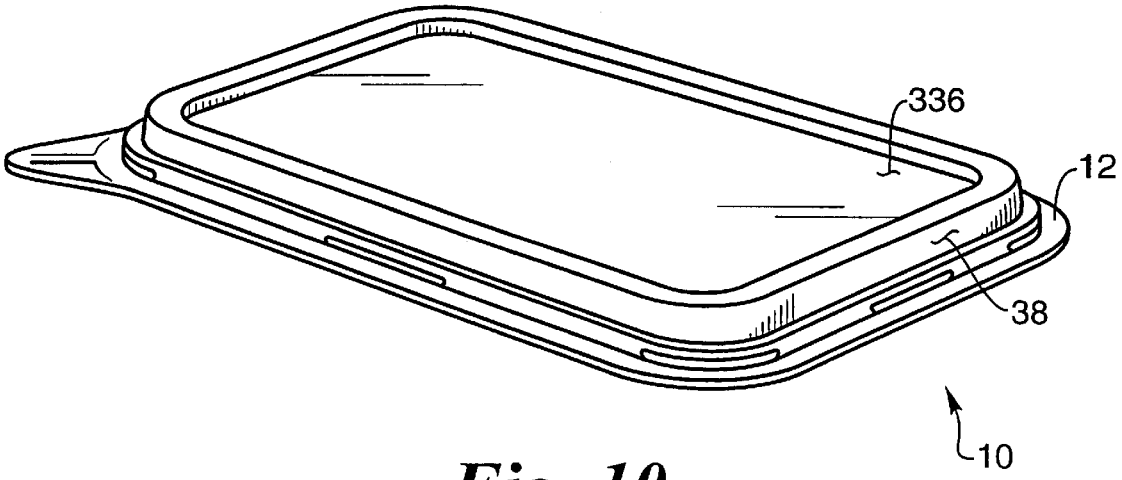
FIG. 10 is a top perspective view of a drop lid

Riser 38 can be longer and attached to a dome lid surface 136 as in FIG. 8, which extends high above the rim 12. Riser 38 may be shorter and attached to a flat lid 236, which is closer to rim 12 as in FIG. 9. Riser 38 may also be of an intermediate height and have a drop lid 336, which drops below the maximum height of riser 38 as in FIG. 10.

Although the outer and inner locking tabs 16, 26 are shown as one large outer tab 16 on a first level and two smaller inner tabs 26 on a second level any number of tabs and any number or sizes of tabs may be used.

Outer and inner locking tabs 16, 26 may also be used in the corners of the lids 10. In the embodiment shown in FIG. 1 a corner locking tab 16 is shown. In the embodiment shown the comer with the removal tab 48 does not have a locking tab for ease of removing the lid 10 from the tray 40.

Further, although the outer and inner locking tabs 16, 26 are shown occupying mutually exclusive portions of the length of the sides of the lid 10 the inner and outer locking tabs may overlap lengthwise.

Alternatively the lid 10 may have a rim 42 as shown on tray 40 in FIG. 3 and the tray 40 may have two sets of locking tabs as shown on the lid 10 to reverse their roles. In this manner the tray has two locking positions to latch the lid to. One position is used before baking and the other after the tray shrinks during baking. Since the tray 40 shrinks the lid 10 will first occupy the smaller inner diameter locking portion of the tray 40 before baking and then larger outer diameter portion after baking.

Figure 4:
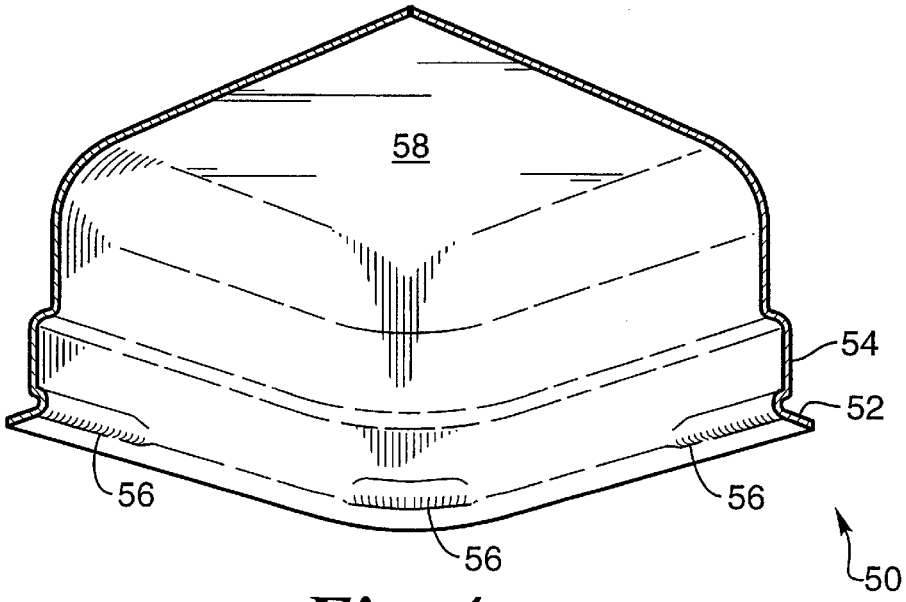
FIG. 4 is a bottom perspective view of lid with a one locking perimeter.
Figure 5:
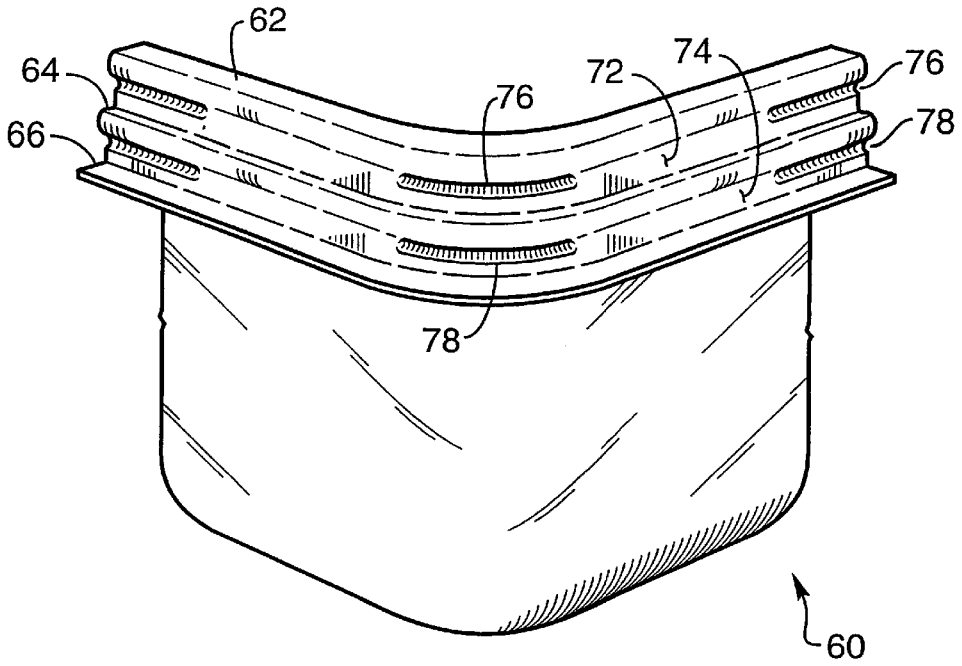
FIG. 5 is a side perspective view of a tray with two lid locking perimeters for engaging the lid of FIG. 4.

In another embodiment, as shown in FIGS. 4 and 5, a lid 50 may have one locking perimeter defined by riser 54 having concave locking portions 56. The lid 50 has a flat rim 52 and a flat cover portion 58. A tray 60 has a flat rim 62 and a riser 72 perpendicular to the rim 62. The riser 72 defines a first perimeter of the tray 60. The riser 72 has a concave portion 76 which aligns with the concave portion 56 of the lid 60 to lock the lid in place on the tray 60 before the tray 60 is baked.

Tray 60 has a runner 64 parallel to the rim 62 and extending perpendicularly from riser 72 to define a second perimeter ending at riser 74 with extends downward from runner 64. Riser 74 has a concave portion 78 which aligns with the concave portion 56 of the lid 50 to lock the lid in place on the tray 60 after the tray 60 is baked. Since the tray shrinks during baking, after baking the concave portion 78 will be at a perimeter equal to the perimeter concave portion 76 before backing.

The tray 60 also has a lip 66 extending perpendicularly from the riser 74 and forming the outer boundary of the tray which may engage outer rim 52 on lid 50 to limit the downward movement of the lid 50.

The lid 50 has a riser 54 long enough to extend the concave portion 56 to the depth of either the concave portion 76 or 78 on tray 60.

The means for engaging the lid 50 to the tray 60 need not be by concave portions 56 and concave portions 76, 78 of the lid 50 and tray 60 respectively, convex portions may be used. Further, other locking means may be employed such as the tabs and lips of the first embodiment or any other means for locking the lids to the trays.

Although the concave 56 and concave 76, 78 portions of the lid 50 and tray 60 have been shown at the corners of the lid 50 and tray 60 other positions around the perimeter of the lid 50 and tray 60 may be used.

Figure 6:
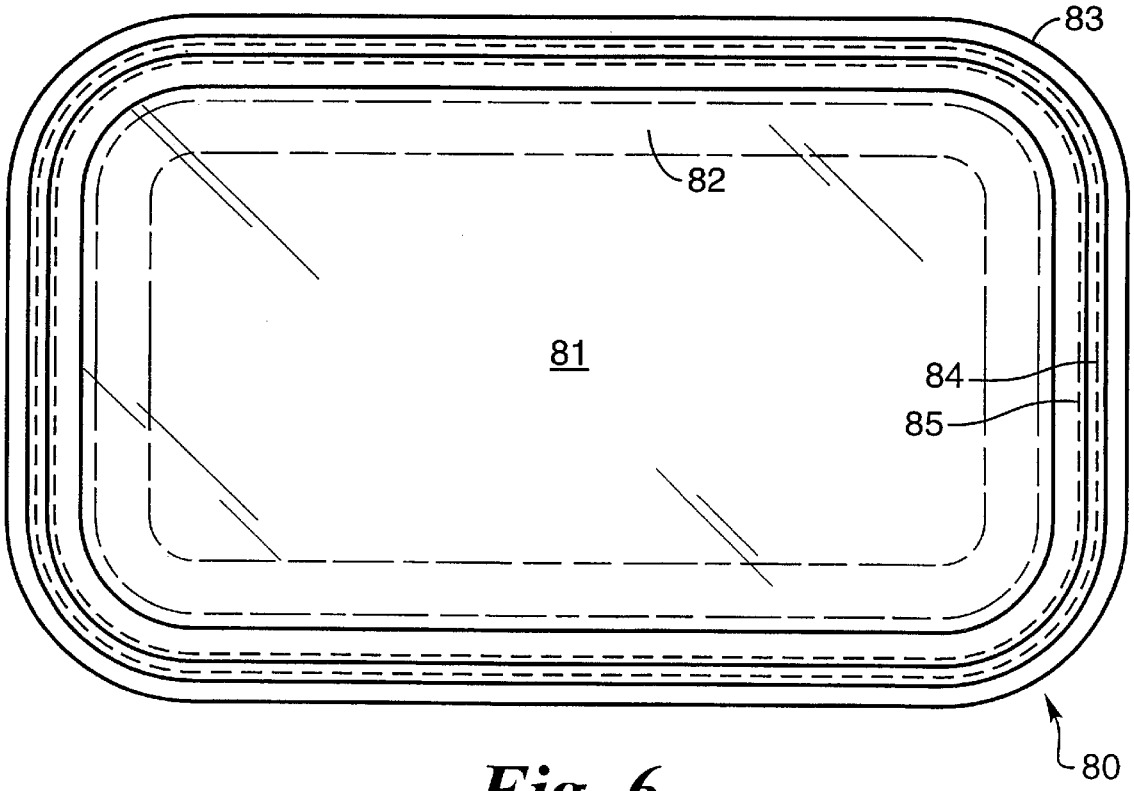
FIG. 6 shows a top view of the tray rim with two concave tracks therein.
Figure 7:
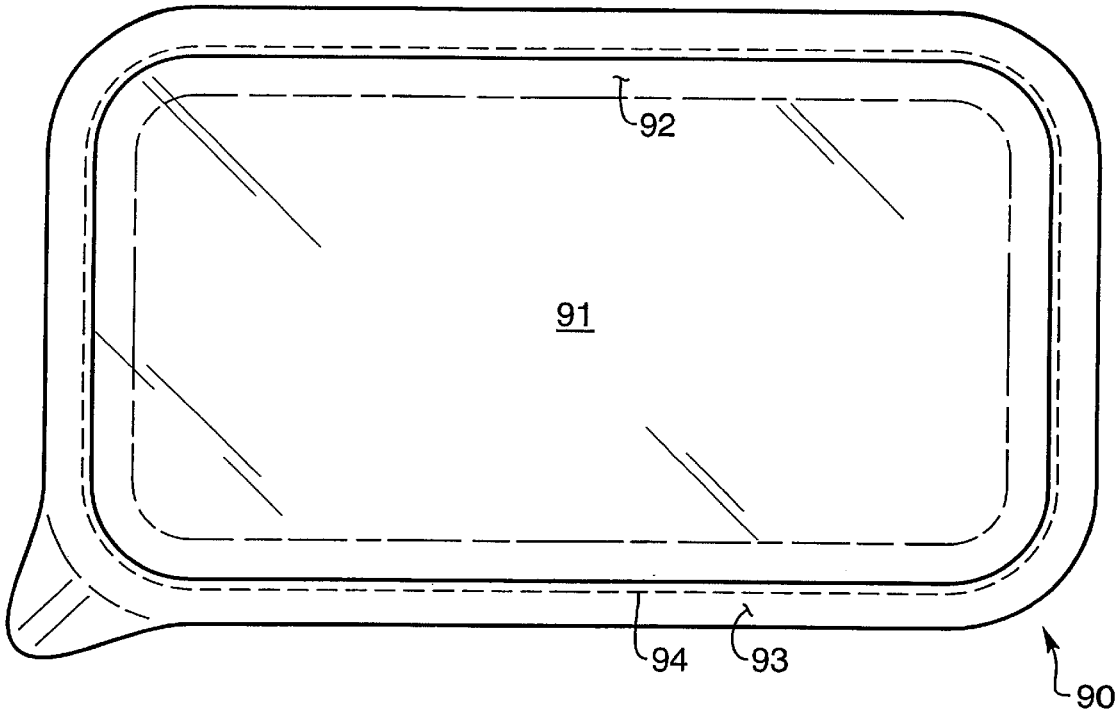
FIG. 7 shows a bottom view of the lid with one convex track therein.

FIGS. 6 and 7 show another embodiment of the invention. This embodiment is similar to that shown in FIGS. 4 and 5 but with the concave portions being continuous around the perimeter. In FIG. 6 a tray 80 has a bottom 81, sides 82 and risers with concave tracks 84 and 85 forming inner and outer perimeters. FIG. 7 shows a lid 90 having a top 91, sides 92, a rim 93 and a perimeter with a convex track 94. The concave track 94 on lid 90 will engage one of the concave tracks 84 or 85 on tray 80 depending on whether the tray expands or contracts due to temperature induced expansion or contraction, thermal shrinking, or stress due to load factors or pressures. Similarly the lid could be supplied with the double track and the tray the single track. Also the concave portions can be reversed forming convex portions. In a further embodiment only a portion of the track needs to have the concave or convex deformations. For example, there can be one or more convex or concave portions on a side for a rectangular container. Also the concave or convex portions may be just in the comers.

Many other combinations of engagement means are possible as well as the numbers of perimeters used on the trays and lids. In addition to concave or convex portions engaging each other, a zip lock style engagement mechanism or other mechanisms may be used.

In another embodiment both the tray and the lid may have two perimeters defined by two risers such that lids from FIG. 1 could be modified to engage trays of FIG. 5.

The above examples have been shown with the trays subjected to thermoplastic shrinking, however the trays or lids may be subjected to changes in size due to a variety of other causes, including, but not limited to, loading stresses from contents in the container, temperature induced thermal expansion or contraction when heated or frozen, changes in pressure or any combination of the above.

The trays and lids may be made of the same materials which expand or contract at the same rates or of different materials which expand or contract at different rates.

Although in all of the above embodiments the trays and lids have been shown with rectangular shapes, the trays and lids may be oval, circular, triangular or have as many sides or shapes as are desired.

Obviously, many modifications and variations of the present invention are possible in light of the above teachings. It is therefore to be understood that, within the scope of the appended claims, the invention may be practiced otherwise than as specifically described.

What is claimed is:

1. A variable size container comprising:

a tray having at least one lid engaging perimeter and a means for interlockingly engaging a lid on each lid engaging perimeter, the lid having at least one tray engaging perimeter and a means for interlockingly engaging the tray on each tray engaging perimeter, such that the tray and lid will be engagable both before and after a change in size occurs in one or more components of the container, wherein the number of engaging perimeters on the tray and the number of engaging perimeters on the lid are not both one.

2. A variable size container as in claim 1 wherein:

the tray has one lid engaging perimeter and the lid has two tray engaging perimeters.

3. A variable size container as in claim 1 wherein:

the lid has one tray engaging perimeter and the tray has two lid engaging perimeters.

4. A variable size container as in claim 1 wherein:

the lid has two tray engaging perimeters and the tray has two lid engaging perimeters.

5. A variable size container as in claim 1 wherein:

the tray has one perimeter with a rim having an edge and the lid has a first locking tab extending from a first riser at a first perimeter and a second locking tab extending from a second riser at a second perimeter, such that the tray rim edge extends under the first locking tab, when the container is in a first size configuration, to lock the lid to the tray, and extends under the second locking tab, when the container is in a second size configuration to lock the lid to the tray.

6. A variable size container as in claim 1 wherein:

the lid has one perimeter with a rim having an edge and the tray has a first locking tab extending from a first riser at a first perimeter and a second locking tab extending from a second riser at a second perimeter, such that the lid rim edge extends under the first locking tab, when the container is in a first size configuration, to lock the tray to the lid, and extends under the second locking tab when the container is in a second size configuration to lock the tray to the lid.

7. A variable size container as in claim 1 wherein:

the tray has a first riser at a first perimeter with at least one convex portion, and a second riser at a second perimeter with at least one convex portion, the lid has one riser with a perimeter and at least one convex portion, such that the convex portion of the lid will engage the convex portion of the first riser in the tray when the container is in a first size configuration and engage the convex portion of the second riser when the container is in a second size configuration.

8. A variable size container as in claim 1 wherein:

the tray has a first riser at a first perimeter with at least one concave portion, and a second riser at a second perimeter with at least one concave portion, the lid has one riser with a perimeter and at least one concave portion, such that the concave portion of the lid will engage the concave portion of the first riser in the tray when the container is in a first size configuration and engage the concave portion of the second riser when the container is in a second size configuration.

9. A variable size container as in claim 1 wherein:

the lid has a first riser at a first perimeter with at least one convex portion, and a second riser at a second perimeter with at least one convex portion, the tray has one riser with a perimeter and at least one convex portion, such that the convex portion of the tray will engage the convex portion of the first riser in the lid when the container is in a first size configuration and engage the convex portion of the second riser when the container is in a second size configuration.

10. A variable size container as in claim 1 wherein:

the lid has a first riser at a first perimeter with at least one concave portion, and a second riser at a second perimeter with at least one concave portion, the tray has one riser with a perimeter and at least one concave portion, such that the concave portion of the tray will engage the concave portion of the first riser in the lid when the container is in a first size configuration and engage the concave portion of the second riser when the container is in a second size configuration.

11. A variable size container as in claim 1 wherein:

the lid has a rim with a first track at a first perimeter with at least one concave portion, and a second track at a second perimeter with at least one concave portion, the tray has a rim with a track with at least one concave portion, such that the concave portion of the tray will engage the concave portion of the first track in the lid when the container is in a first size configuration and engage the concave portion of the second track when the container is in a second size configuration.

12. A variable size container as in claim 1 wherein:

the tray has a rim with a first track at a first perimeter with at least one concave portion, and a second track at a second perimeter with at least one concave portion, the lid has a rim with a track with a at least one concave portion, such that the concave portion of the lid will engage the concave portion of the first track in the tray when the container is in a first size configuration and engage the concave portion of the second track when the container is in a second size configuration.

13. A variable size container as in claim 1 wherein:

the lid has a rim with a first track at a first perimeter with at least one convex portion, and a second track at a second perimeter with at least one convex portion, the tray has a rim with a track with at least one convex portion, such that the convex portion of the tray will engage the convex portion of the first track in the lid when the container is in a first size configuration and engage the convex portion of the second track when the container is in a second size configuration.

14. A variable size container as in claim 1 wherein:

the tray has a rim with a first track at a first perimeter with at least one convex portion, and a second track at a second perimeter with at least one convex portion, the lid has a rim with a track with at least one convex portion, such that the convex portion of the lid will engage the convex portion of the first track in the tray when the container is in a first size configuration and engage the convex portion of the second track when the container is in a second size configuration.

15. A container having a dual size locking tray lid comprising:

a lid having a first perimeter with a first length and a second perimeter with a second length different from the first length, the first perimeter having at least one locking tab at a first height and the second perimeter having at least one locking tab at a second height such that the lid can be lockingly attached to a tray at two different heights.

16. A container having a dual size locking tray lid as in claim 15 further comprising:

a plastic tray which shrinks when exposed to heat having a rim for engaging the tray lid, wherein the tray has a first size before it shrinks where the rim fits under the first locking tab of the lid and the tray has a second size after it shrinks where the rim fits under the second locking tab of the lid.

17. A container having a dual size locking tray lid as in claim 15 wherein:

the lid first perimeter has four sides and a central locking tab on each side extending from the center of the perimeter side towards the ends of the perimeter sides and, the lid second perimeter has four sides and two locking tabs on each side, one locking tab on either end of the length of the central locking tabs.

18. A container having a dual size locking tray lid as in claim 17 wherein:

the lid has a removal tab extending from the lid at one corner thereof such that the lid can be easily gripped to put force on the lid to remove the lid from the tray.

19. A container having a dual size locking tray lid as in claim 16 wherein:

the first perimeter has four sides and a central locking tab on each side extending from the center towards the ends of the sides and, the second perimeter has four sides and two locking tabs on each side, one locking tab on either end of the length of the central locking tabs.

20. A container having a dual size locking tray lid as in claim 19 wherein:

the lid has a removal tab extending from the lid at one corner thereof such that the lid can be easily gripped to put force on the lid to deform it and release the lid locking tabs from the tray lip.

21. A container having a dual size locking tray lid as in claim 15 wherein:

the lid has an oval shape with an oval first perimeter and a locking tab on at least a portion of the first perimeter and, an oval shape second perimeter and a locking tab on at least a portion of the second perimeter.

22. A container having a dual size locking tray lid as in claim 21 further comprising:

a plastic tray which shrinks when exposed to heat having a rim for engaging the tray lid, wherein the tray has a first size before it shrinks where the rim fits under the first locking tab of the lid and the tray has a second size after it shrinks where the rim fits under the second locking tab of the lid.

23. A container having a dual size locking tray lid as in claim 22 wherein:

the lid has a removal tab extending from the lid at one corner thereof such that the lid can be easily gripped to put force on the lid to remove the lid from the tray.

24. A container having a dual size locking tray lid as in claim 15 wherein:

the lid has a circular shape with an circular first perimeter and a locking tab on at least a portion of the first perimeter and, a circular shape second perimeter and a locking tab on at least a portion of the second perimeter.

25. A container having a dual size locking tray lid as in claim 24 further comprising:

a plastic tray which shrinks when exposed to heat having a rim for engaging the tray lid, wherein the tray has a first size before it shrinks where the rim fits under the first locking tab of the lid and the tray has a second size after it shrinks where the rim fits under the second locking tab of the lid.

26. A container having a dual size locking tray lid as in claim 25 wherein:

the lid has a removal tab extending from the lid at one comer thereof such that the lid can be easily gripped to put force on the lid to remove the lid from the tray.

27. A container having a dual size locking tray comprising:

a tray having a first perimeter with a first length and a second perimeter with a second length different from the first length, the first perimeter having at least one locking tab at a first height and the second perimeter having a at least one locking tab at a second height such that the tray can be lockingly attached to a lid at two different heights.

28. A container having a dual size locking tray as in claim 27 wherein:

the tray comprises a plastic tray which shrinks when baked such that the tabs at the first height and first perimeter engage a rim on the lid before baking and tabs at the second height and second perimeter engage the rim on the lid after baking.

29. A container having a dual size locking tray as in claim 27 wherein:

the tray first perimeter has four sides and a central locking tab on each side extending from the center of the perimeter side towards the ends of the perimeter sides and, the tray second perimeter has four sides and two locking tabs on each side, one locking tab on either end of the length of the central locking tabs.

30. A container having a dual size locking tray as in claim 29 wherein:

the lid has a removal tab extending from the lid at one corner thereof such that the lid can be easily gripped to put force on the lid to remove the lid from the tray.

31. A container having a dual size locking tray as in claim 28 wherein:

the first perimeter has four sides and a central locking tab on each side extending from the center towards the ends of the sides and, the second perimeter has four sides and two locking tabs on each side, one locking tab on either end of the length of the central locking tabs.

32. A container having a dual size locking tray as in claim 31 wherein:

the lid has a removal tab extending from the lid at one corner thereof such that the lid can be easily gripped to put force on the lid to deform it and release the lid locking tabs from the tray lip.

33. A container having a dual size locking tray as in claim 27 wherein:

the tray has an oval shape with an oval first perimeter and a locking tab on at least a portion of the first perimeter and, an oval shape second perimeter and a locking tab on at least a portion of the second perimeter.

34. A container having a dual size locking tray as in claim 33 further comprising:

the tray comprises a plastic tray which shrinks when baked such that the tabs at the first height and first perimeter engage a rim on the lid before baking and tabs at the second height and second perimeter engage the rim on the lid after baking.

35. A container having a dual size locking tray as in claim 34 wherein:

the lid has a removal tab extending from the lid on one portion thereof such that the lid can be easily gripped to put force on the lid to remove the lid from the tray.

36. A container having a dual size locking tray as in claim 35 wherein:

the lid has a circular shape with an circular first perimeter and a locking tab on at least a portion of the first perimeter and, a circular shape second perimeter and a locking tab on at least a portion of the second perimeter.

37. A container having a dual size locking tray as in claim 36 further comprising:

the tray comprises a plastic tray which shrinks when baked such that the tabs at the first height and first perimeter engage a rim on the lid before baking and tabs at the second height and second perimeter engage the rim on the lid after baking.

38. A container having a dual size locking tray as in claim 37 wherein:

the lid has a removal tab extending from the lid at one corner thereof such that the lid can be easily gripped to put force on the lid to remove the lid from the tray.

39. A dual size locking container comprising:

a tray having a first perimeter with a first height and a first tray locking portion and a second perimeter having a second height with a second tray locking portion, a lid with a perimeter having a lid locking portion, such that the lid locking portion can engage the tray locking portion of the tray at the first perimeter and first height before the tray and/or lid changes size and at the second perimeter and second height after the tray and/or lid changes size.

40. A dual size locking container as in claim 39 wherein:

the locking portions on the tray are convex portions and the locking portion of lid is a convex portion which engages the convex portions of the tray to lock the lid to the tray.

41. A dual size locking container as in claim 39 wherein:

the locking portions on the tray are concave portions and the locking portion of lid is a concave portion which engages the concave portions of the tray to lock the lid to the tray.

42. A dual size locking container as in claim 40 wherein:

the first tray perimeter has four sides and four corners wherein the locking portions are on the four corners, the second tray perimeter has four sides and four corners wherein the locking portions are on the four corners, the lid perimeter has four sides and four corners wherein the locking portions are on the four corners.

43. A dual size locking container as in claim 39 wherein:

the lid has a removal tab extending from the lid at one corner thereof such that the lid can be easily gripped to put force on the lid to release the lid locking portions from the tray locking portions.

44. A dual size locking container as in claim 41 wherein:

the first tray perimeter has four sides and four comers wherein the locking portions are on the four comers, the second tray perimeter has four sides and four corners wherein the locking portions are on the four comers, the lid perimeter has four sides and four comers wherein the locking portions are on the four comers.

45. A dual size locking container as in claim 44 wherein:

the lid has a removal tab extending from the lid at one comer thereof such that the lid can be easily gripped to put force on the lid to release the lid locking portions from the tray locking portions.

46. A dual size locking container as in claim 40 wherein:

the first tray perimeter has four sides wherein the locking portions are on the four sides, the second tray perimeter has four sides wherein the locking portions are on the four sides, the lid perimeter has four sides wherein the locking portions are on the four sides.

47. A dual size locking container as in claim 41 wherein:

the first tray perimeter has four sides wherein the locking portions are on the four sides, the second tray perimeter has four sides wherein the locking portions are on the four sides, the lid perimeter has four sides wherein the locking portions are on the four sides.

48. A dual size locking container as in claim 40 wherein:

the first tray perimeter is an oval, the second tray perimeter is an oval, the lid perimeter is an oval.

49. A dual size locking container as in claim 41 wherein:

the first tray perimeter is an oval, the second tray perimeter is an oval, the lid perimeter is an oval.

50. A dual size locking container as in claim 40 wherein:

the first tray perimeter is a circle, the second tray perimeter is a circle, the lid perimeter is a circle.

51. A dual size locking container as in claim 41 wherein:

the first tray perimeter is a circle, the second tray perimeter is a circle, the lid perimeter is a circle.

52. A dual size locking container comprising:

a lid having a first perimeter with a first height and a first lid locking portion and a second perimeter having a second height with a second lid locking portion, a tray with a perimeter having a tray locking portion, such that the tray locking portion can engage the lid locking portion of the lid at the first perimeter and first height before the tray and/or lid changes size and at the second perimeter and second height after the tray and/or lid changes size.

53. A dual size locking container comprising:

a tray having a first perimeter with a first track locking portion and a second perimeter having a second track with a second track locking portion, a lid with a perimeter with a track locking portion, such that the lid track locking portion can engage the tray locking portion of the tray at the first perimeter before the tray and/or lid changes size and at the second perimeter after the tray and/or lid changes size.

54. A dual size locking container as in claim 53 wherein:

the perimeters on the lids and trays are rectangular.

55. A dual size locking container as in claim 53 wherein:

the perimeters on the lids and trays are ovals.

56. A dual size locking container as in claim 53 wherein:

the perimeters on the lids and trays are circles.

57. A dual size locking container comprising:

a lid having a rim with first perimeter with a first track locking portion and a second perimeter having a second track with a second track locking portion, a tray having a rim with a perimeter with a track locking portion, such that the tray track locking portion can engage the lid locking portion of the lid at the first perimeter before the tray and/or lid changes size and at the second perimeter after the tray and/or lid changes size.

58. A plastic container in which food items can be baked, said plastic container comprising:

a tray having a first size prior to being exposed to baking temperatures and a second size after being exposed to baking temperatures, a lid for said tray a first set of closure elements associated with the tray and lid for securing the lid to the tray when the tray is of said first size, and a second set of closure elements associated with the tray and lid for securing the lid to the tray when the tray is of said second size.

59. A plastic container of claim 58 wherein:

said tray comprises a base, a side wall projecting upwardly from said base, a rim projecting outwardly from the top portion of said side wall and a lip projecting outwardly from said rim, said lid comprising a top and a downwardly projecting sidewall, said side wall having a first riser a first runner and a second riser, said first set of closure elements comprising a plurality of tabs projecting inwardly from said first riser which engage the lip of said tray to secure the lid to the tray when the tray is of a first size and, said second set of closure elements comprising a plurality of tabs projecting inwardly from said second riser which engage the lip of said tray to secure the lid to the tray when the tray is of a second size.

60. A plastic container of claim 58 wherein:

said tray comprises a base, a side wall projecting upwardly from the base, said side wall having a first riser, a first runner, and a second riser, said lid comprising a top, a downwardly projecting sidewall and a lip projecting from the sidewall, said first set of closure elements comprising a plurality of tabs projecting from said first user which engage the lip of said lid to secure the lid to the tray when the tray is of a first size, and said first set of closure elements comprising a plurality of tabs projecting from said second riser which engage the lip of said lid to secure the lid to the tray when said tray is of a second size.

* * * * *